US007440723B2

(12) United States Patent
Uehara et al.

(10) Patent No.: US 7,440,723 B2
(45) Date of Patent: Oct. 21, 2008

(54) IMAGE FORMING APPARATUS AND FIXING DEVICE

(75) Inventors: Junji Uehara, Inazawa (JP); Yasushi Fujiwara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 276 days.

(21) Appl. No.: 11/482,108

(22) Filed: Jul. 7, 2006

(65) Prior Publication Data

US 2007/0053730 A1 Mar. 8, 2007

(30) Foreign Application Priority Data

Jul. 8, 2005 (JP) ..... 2005-199911

(51) Int. Cl.
*G03G 15/20* (2006.01)

(52) U.S. Cl. ..... 399/328

(58) Field of Classification Search ..... 399/328, 399/331; 219/216, 469–471
See application file for complete search history.

(56) References Cited

U.S. PATENT DOCUMENTS 5,111,250 A * 5/1992 Kashiwagi ..... 219/216
5,283,621 A * 2/1994 Hashizume ..... 399/331
6,282,398 B1 * 8/2001 Higashi ..... 219/216
2004/0234290 A1 11/2004 Tomatsu

FOREIGN PATENT DOCUMENTS

| | | |
|---|---|---|
| JP | 7-92846 | 4/1995 |
| JP | 8-254913 | 10/1996 |
| JP | 8-305212 | 11/1996 |
| JP | 10-1614710 | 6/1998 |
| JP | 2001-154525 | 6/2001 |
| JP | 2004-77939 | 3/2004 |
| JP | 2004-279702 | 10/2004 |

* cited by examiner

*Primary Examiner*—Susan S Lee
(74) *Attorney, Agent, or Firm*—Banner & Witcoff, Ltd

(57) ABSTRACT

A pressure roller support member that rotatably supports a pressure roller is supported to a fixing unit case so as to be capable of swaying. A spacer member is supported to the pressure roller support member so as to be capable of swaying. A spacer section is formed at an end of the spacer member. When the spacer member sways, the spacer section moves between a first position where the spacer section is clamped between the fixing unit case and the pressure roller support member and a second position where the clamp between the fixing unit case and the pressure roller support member is released.

14 Claims, 5 Drawing Sheets

IMAGE FORMING APPARATUS AND FIXING DEVICE

BACKGROUND OF THE INVENTION

1. Field of the Invention

The present invention relates to an image forming apparatus that is configured to fix an image by a developer onto a sheet-like recording medium to thereby form an image onto the recording medium. Further, the present invention relates to a fixing device that is mounted to a main body of the above-mentioned image forming apparatus and configured to fix the image by the developer onto the recording medium.

2. Description of the Related Art

This type of the image forming apparatus accommodates a fixing device in a main body case of the image forming apparatus. This fixing device has a heat roller and a pressing roller (counter roller) arranged so as to face the heat roller. Those disclosed in the following patent documents have been known as the configuration of the image forming apparatus and fixing device described above in which the press-contact state between the heat roller and the pressing roller can be changed in accordance with the state (during the transportation or storage, or during the use) of the image forming apparatus or the type of sheet; Japanese Patent Application Laid-Open (kokai) No. 2004-279702, 2004-77939, 2001-154525, 10-161470, 08-305212, 08-254913, 07-92846.

SUMMARY OF THE INVENTION

In this type of the image forming apparatus and fixing device provided with a press-contact state adjusting mechanism for changing the press-contact state between the heat roller and the pressing roller, a press-contact state adjusting mechanism having the configuration of achieving miniaturization and simplification of the image forming apparatus and the fixing device has been demanded. It is to be noted that the aforesaid pressing roller may sometimes be referred to as a counter roller, since it is arranged so as to face the heat roller. The pressing roller may sometimes be referred to as a pressure roller, since it is arranged to apply pressure to the heat roller.

(1-1) The fixing device that is the subject of the present invention is configured to be capable of fixing an image by a developer onto a sheet-like recording medium, and has a heat roller, a counter roller, and a fixing unit case.

This heat roller is arranged along a widthwise direction of the recording medium that is perpendicular to a transporting direction and a thickness direction of the recording medium. It is configured to be capable of heating the developer.

The counter roller is arranged along the widthwise direction of the recording medium so as to oppose to the heat roller. This counter roller is configured to rotate as nipping the recording medium with the heat roller to thereby be capable of sending the recording medium in the transporting direction.

The fixing unit case is configured to rotatably support both end portions of the heat roller in the widthwise direction and to cover the heat roller.

The feature of the present invention is such that the fixing device thus configured has the configuration described below.

The fixing device according to the present invention has a counter roller support member and a spacer member, in addition to the aforesaid configuration.

The counter roller support member is supported at both end portions of the widthwise direction of the fixing unit case in a swayable manner. The counter roller support member is configured to support both end portions of the counter roller in the widthwise direction.

The spacer member is composed of a spacer section and a spacer support section. The spacer section is configured to be clamped between the fixing unit case and the counter roller support member in order to adjust a distance between a shaft of the heat roller and a shaft of the counter roller. The spacer support member is provided so as to extend from the spacer section.

In the fixing device according to the present invention, the spacer support member at the spacer member is supported by the counter roller support member so as to sway between a first position and a second position. The first position here means the position where the spacer section is clamped between the fixing unit case and the counter roller support member. The second position here means the position where the spacer section is not clamped between the fixing unit case and the counter roller support member.

In this configuration, the press-contact state adjusting mechanism for changing the press-contact state between the heat roller and the counter roller (pressing roller) is composed of the aforesaid spacer member. This spacer member is mounted to the counter roller support member in the swayable manner, as described above. Specifically, the above-mentioned press-contact state adjusting mechanism is always mounted to the counter roller support member constituting the fixing device.

According to this configuration, the spacer member is always mounted to the fixing device, even in the case where it is unnecessary to use the spacer member. Therefore, the loss of the spacer member is prevented.

The aforesaid press-contact state adjusting mechanism is mounted to the fixing device, not to the main body of the image forming apparatus. Therefore, the configuration of the fixing device capable of adjusting the above-mentioned press-contact state can be realized more simply without using a motor or cam mechanism mounted to the main body. Specifically, the configuration of the fixing device can be realized more simply which is capable of adjusting the press-contact state even if the power source of the image forming apparatus is cut off. In particular, the permanent set of the counter roller can be inhibited by releasing or easing the aforesaid press-contact state when the image forming apparatus is not used. Accordingly, the service life of the fixing device can be prolonged.

The device configuration according to the above-mentioned press-contact state adjusting mechanism can be made simple and compact, and therefore, the fixing device and the image forming apparatus can be made compact and the cost for the fixing device and the image forming apparatus can be reduced.

(1-2) The fixing unit case and the counter roller support member in the fixing device having the configuration disclosed in the aforesaid (1-1) may be configured to expose a peripheral surface of the counter roller at a side opposite to a side facing the heat roller.

According to this configuration, the maintenance property of the fixing device is further enhanced.

According to this configuration, the cover member for covering the counter roller is omitted, so that the outer dimension of the fixing device can be reduced. Therefore, further miniaturization of the fixing device is made possible.

(1-3) The spacer member in the fixing device having the configuration disclosed in the aforesaid (1-1) and (1-2) may be arranged outward, in the widthwise direction, from a fixing area where the recording medium is nipped between the heat roller and the counter roller.

According to this configuration, the spacer member is located at the position apart from the peripheral surfaces of the heat roller and the counter roller used for the image fixing operation to the recording medium. Therefore, the poor image formation due to the damage on the peripheral surfaces by the spacer member can be inhibited.

(1-4) A spacer operation section that is communicated with the spacer support section and can be operated from the outside of the fixing unit case may be formed at the spacer member in the fixing device having the configuration disclosed in the aforesaid (1-1) to (1-3).

According to this configuration, the press-contact state between the heat roller and the counter roller can easily be adjusted by operating the spacer operation section from the outside of the fixing unit case.

(1-5) The fixing device having the configuration disclosed in the aforesaid (1-1) to (1-4) may further have a spacer urging member. The spacer urging member is configured to urge the spacer support section in the direction in which the spacer section moves toward the first position or the second position.

Specifically, in this configuration, the spacer member is always urged, for example, in the direction in which the spacer member moves to the first position by the spacer urging member. Alternately, the spacer member is always urged by the spacer urging member in the direction in which the spacer member moves to the second position.

According to this configuration, the sway movement of the spacer section can more smoothly be performed. For example, the counter roller support member is manually operated to change the positional relationship between the fixing unit case and the counter roller support member, whereby the spacer section can automatically move to the desired position.

(1-6) The fixing device having the configuration disclosed in the aforesaid (1-5) may further have a counter roller urging member. This counter roller urging member is configured to always urge the counter roller support member in a direction in which the counter roller presses the heat roller.

According to this configuration, the adjustment of the press-contact state between the heat roller and the counter roller due to the sway movement of the spacer member can easily be performed by interlocking the spacer urging member with the counter roller urging member.

In the case where the spacer urging member is configured to urge the spacer section toward the first position, for example, the operation is as follows. It is assumed that the spacer section is at the first position in the initial state (e.g., when the fixing device is shipped from a factory). At this time, the spacer section is clamped between the fixing unit case and the counter roller support member with a predetermined pressure by the counter roller urging member as always urged toward the first position. Accordingly, the condition in which the press-contact between the heat roller and the counter roller is released or eased can surely be maintained in the initial state.

Alternately, in the case where the spacer urging member is configured to urge the spacer section toward the second position, for example, the operation is as follows. It is assumed that the spacer section is at the first position in the initial state (e.g., when the fixing device is shipped from a factory). At this time, the spacer section is clamped between the fixing unit case and the counter roller support member with a predetermined pressure by the counter roller urging member as always urged toward the second position. Thereafter, when the counter roller support member is manually operated against the counter roller urging member upon the use of the fixing device for the image formation so that the clamping of the spacer section between the fixing unit case and the counter roller support member is temporarily released, the spacer section automatically and promptly moves to the second position by the spacer urging member. Therefore, the press-contact state between the heat roller and the counter roller can be set to an appropriate state for performing image formation onto a predetermined recording medium.

(1-7) A counter roller operation section that can be operated from the outside of the fixing unit case may be formed at the counter roller support member in the fixing device having the configuration disclosed in the aforesaid (1-6).

According to this configuration, the adjustment of the press-contact state between the heat roller and the counter roller by the sway movement of the spacer member can more easily be performed.

In the case where the spacer section is at the first position in the initial state and the spacer urging member is configured to urge the spacer section toward the second position, the operation is as follows. Firstly, the spacer section is clamped between the fixing unit case and the counter roller support member with a predetermined pressure by the counter roller urging member as always urged toward the second position in the initial state. Thereafter, the counter roller support member is manually operated upon the use of the fixing device for the image formation, so that the clamping of the spacer section between the fixing unit case and the counter roller support member is temporarily released against the counter roller support member. Consequently, the spacer section automatically and promptly moves to the second position by the spacer urging member. The manual operation of the counter roller operation section described above can easily be carried out from the outside of the fixing unit case.

In the case where the spacer urging member is configured to urge the spacer section toward the first position, for example, the operation is as follows. When the fixing device is not used for a long time, the counter roller operation section is manually operated in the direction against the counter roller urging member, whereby the space between the fixing unit case and the counter roller support member is widened. Therefore, the spacer section moves to the first position. Thereafter, when the manual operation of the counter roller operation section is released, the space between the fixing unit case and the counter roller support member is decreased by the counter roller urging member. Accordingly, the spacer section is maintained at the first position as clamped between the fixing unit case and the counter roller support member.

(2-1) The image forming apparatus that is the subject of the present invention has a fixing unit that is configured to be capable of fixing an image by a developer attached onto the recording medium on the recording medium, and a main body to which the fixing unit is mounted. The fixing unit has a heat roller, a counter roller, and a fixing unit case.

The heat roller is arranged along a widthwise direction of the recording medium that is perpendicular to a transporting direction and a thickness direction of the recording medium. It is configured to be capable of heating the developer.

The counter roller is arranged along the widthwise direction of the recording medium so as to face the heat roller. This counter roller is configured to rotate as nipping the recording medium with the heat roller to thereby be capable of sending the recording medium in the transporting direction.

The fixing unit case is configured to rotatably support both end portions of the heat roller in the widthwise direction and to cover the heat roller.

The main body has a fixing unit mounting section to which the fixing unit is mounted by insertion of the fixing unit in a predetermined inserting direction.

The fixing unit case is configured to be capable of being mounted to the fixing unit mounting section.

The feature of the present invention is such that the image forming apparatus thus configured has the configuration described below.

In addition to the aforesaid configuration, the image forming apparatus according to the present invention has such a configuration that the fixing unit has a counter roller support member and a spacer member.

The counter roller support member is a member that rotatably supports both end portions of the counter roller in the widthwise direction. It is supported at both end portions of the widthwise direction of the fixing unit case in a swayable manner.

The spacer member is composed of a spacer section and a spacer support section.

The spacer section is configured to be clamped between the fixing unit case and the counter roller support member in order to adjust a distance between a shaft of the heat roller and a shaft of the counter roller.

The spacer support member is a member for supporting the spacer section, and is provided so as to extend from the spacer section.

The spacer support member at the spacer member is supported by the counter roller support member so as to be capable of swaying between a first position and a second position. The first position here means the position where the spacer section is clamped between the fixing unit case and the counter roller support member. The second position here means the position where the spacer section is not clamped between the fixing unit case and the counter roller support member.

In this configuration, the press-contact state adjusting mechanism for changing the press-contact state between the heat roller and the pressing roller is composed of the aforesaid spacer member. This spacer member is mounted to the counter roller support member in the swayable manner, as described above. Specifically, the above-mentioned press-contact state adjusting mechanism is always mounted in the main body of the image forming apparatus having the fixing unit incorporated therein.

According to this configuration, the spacer member is always mounted to the main body of the image forming apparatus, even in the case where it is unnecessary to use the spacer member. Therefore, the loss of the spacer member is prevented.

The aforesaid press-contact state adjusting mechanism is mounted to the fixing unit, not to the main body of the image forming apparatus. Therefore, the configurations of the image forming apparatus and the fixing unit capable of adjusting the above-mentioned press-contact state can be realized more simply without using a motor or cam mechanism mounted to the main body. Specifically, the configurations of the image forming apparatus and the fixing unit can be realized more simply which is capable of adjusting the press-contact state even if the power source of the image forming apparatus is cut off. In particular, the permanent set of the counter roller can be inhibited by releasing or easing the aforesaid press-contact state when the image forming apparatus is not used. Accordingly, the service life of the fixing unit can be prolonged, and hence, the labor for the maintenance to the image forming apparatus can be reduced.

The device configuration according to the above-mentioned press-contact state adjusting mechanism can be made simple and compact, and therefore, the image forming apparatus can be made compact and the cost for the image forming apparatus can be reduced.

(2-2) The fixing unit case and the counter roller support member in the image forming apparatus having the configuration disclosed in the aforesaid (2-1) may be configured to expose a peripheral surface of the counter roller at a side opposite to a side facing the heat roller.

According to this configuration, the maintenance property of the image forming apparatus is further enhanced.

According to this configuration, the cover member for covering the counter roller is omitted, so that the outer dimension of the fixing unit can be reduced. Thus, the fixing unit mounting section at the main body can be downsized. Therefore, further miniaturization of the image forming apparatus is made possible.

(2-3) The spacer member in the image forming apparatus having the configuration disclosed in the aforesaid (2-1) and (2-2) may be arranged outward, in the widthwise direction, from a fixing area where the recording medium is nipped between the heat roller and the counter roller.

According to this configuration, the damage on the peripheral surfaces of the heat roller and the counter roller by the spacer member during the image fixing operation by the image forming apparatus can be Inhibited. Accordingly, satisfactory image formation free from undesirable vertical stripes can stably be performed.

(2-4) A spacer operation section that is communicated with the spacer support section may be formed at the spacer member in the image forming apparatus having the configuration disclosed in the aforesaid (2-1) to (2-3). This spacer operation section may be provided to project from the fixing unit toward a near side in the inserting direction in order to be capable of being operated from the outside of the main body.

According to this configuration, the press-contact state between the heat roller and the counter roller can easily be adjusted from the outside of the main body.

(2-5) The image forming apparatus having the configuration disclosed in the aforesaid (2-1) to (2-4) may further have a spacer urging member. The spacer urging member is configured to urge the spacer support section in the direction in which the spacer member moves toward the first position or the second position.

According to this configuration, the sway movement of the spacer section can more smoothly be performed.

(2-5) The image forming apparatus having the configuration disclosed in the aforesaid (2-4) may further have a counter roller urging member. This counter roller urging member is configured to urge the counter roller support member in the direction in which the counter roller presses the heat roller.

According to this configuration, the adjustment of the press-contact state between the heat roller and the counter roller due to the sway movement of the spacer member can easily be performed by interlocking the spacer urging member with the counter roller urging member.

(2-6) In the image forming apparatus having the configuration disclosed in the aforesaid (2-5), a lever-like counter roller operation section may be formed at the counter roller support member, and the counter roller support member may be provided so as to project from the fixing unit toward a near side in the inserting direction in order to be capable of being operated from the outside of the main body.

According to this configuration, the press-contact state between the heat roller and the counter roller can easily be adjusted from the outside of the main body.

BRIEF DESCRIPTION OF THE DRAWINGS

FIGS. 4A and 4B are enlarged perspective views of the surrounding of the handle and the spacer member shown in FIG. 3, wherein FIG. 4A is an enlarged perspective view of the surrounding of the spacer member when the spacer member is seen from the inside in the sheet widthwise direction, and FIG. 4B is an enlarged perspective view of the essential part of the spacer member when the spacer member is seen from the outside; and FIGS. 5A and 5B are perspective views showing the state of the sway of the spacer member shown in FIGS. 4A and 4B, wherein FIG. 5A is an enlarged perspective view of the surrounding of the spacer member when the spacer member is seen from the inside in the sheet widthwise direction, and FIG. 5B is an enlarged perspective view of the essential part of the spacer member when the spacer member is seen from the outside.

DESCRIPTION OF THE PREFERRED EMBODIMENT

Embodiments of the present invention (embodiments that are considered to be the best mode by the present applicant for the time being at the filing of this application) will be explained with reference to drawings.

<Entire Configuration of Laser Printer>

Figure 1:
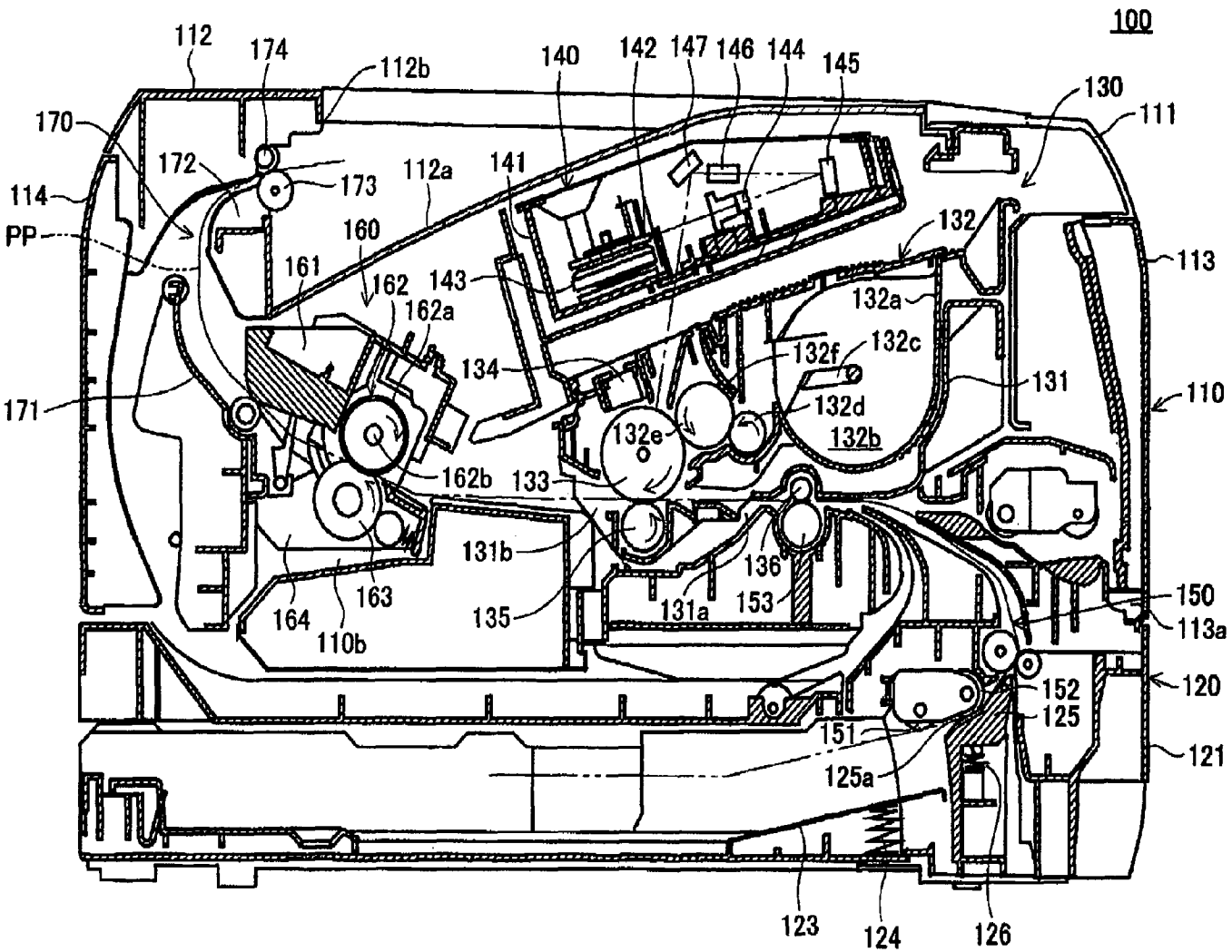
FIG. 1 is a side sectional view showing a schematic configuration of a laser printer according to an embodiment of the present invention.

FIG. 1 is a side sectional view of a laser printer 100 according to one embodiment of the image forming apparatus of the present invention.

The laser printer 100 has a main body 110 and a feeder unit 120 for feeding a recording medium (sheet) to the main body 110. A process cartridge 130 for forming an image by a developer (toner) onto the sheet is detachably mounted in the main body 110. A scanner unit 140 for applying a laser beam to a photosensitive drum 133 provided to the process cartridge 130 is arranged in the main body 110. Further, arranged in the main body 110 are a sheet feed section 150 for feeding a sheet to the process cartridge 130, a fixing unit 160 for fixing onto the sheet the image formed with a toner on the sheet by the process cartridge 130, and a sheet ejection section 170 for ejecting the sheet that has been subject to the fixing unit 160 to the outside of the laser printer 100.

<<Explanation of terms "sheet transporting direction", "sheet widthwise direction", "front face", "back face">>

The laser printer 100 is configured such that the sheet is transported along the sheet transporting path PP (paper path that is shown by a two-dot-chain line in the figure). Therefore, in the following explanation, the direction from the feeder unit 120 toward the sheet ejection section 170 along the sheet transporting path PP in FIG. 1 is referred to as "sheet transporting direction".

The edge portion at the right side of the laser printer 100 in the figure is referred to as "front face", and the edge portion at the left side of the laser printer 100 in the figure is referred to as "back face". The side-to-side direction in FIG. 1 is the lengthwise direction of the laser printer 100.

The direction (i.e., the direction of the normal line in FIG. 1: the widthwise direction of the laser printer 100) vertical to the side-to-side direction in FIG. 1 (the lengthwise direction of the laser printer 100) and the vertical direction (height direction of the laser printer 100) is referred to as "sheet widthwise direction".

<<Configuration of casing of main body>>

An outer cover 111 has a shape of a generally rectangular solid constituting the main body 110. It is integrally made of a synthetic resin plate. This outer cover 111 is formed so as to cover the main body frame (later-described main body frame 110*a*: see FIG. 2) that supports various components accommodated in the main body 110.

A recess section that becomes shallow toward the front face side (right side in the figure) is formed at a top cover 112, constituting the upper face of the outer cover 111, at the back face side (left side in the figure). The bottom face of the recess section forms a catch tray 112*a* on which the sheet having the image formed thereon is placed. Specifically, this catch tray 112*a* is composed of a slope formed to extend diagonally down toward the back face side (left side in the figure) from the front face side (right side in the figure) of the top cover 112. A sheet ejection port 12*b* made of an opening section is provided above the lower end portion (the end portion at the lower left side in the figure) of the catch tray 112*a* at the outer cover 111. Specifically, the aforesaid catch tray 112*a* receives the sheet that is ejected from the sheet ejection port 112*b* and has an image formed thereon, and stacks thereon about one hundred sheets having an image formed thereon.

A front cover 113 is attached to the outer cover 111 at the front face side. This front cover 113 is supported by the outer cover 111 so as to be capable of being opened and closed by the pivot movement about a hinge section 113*a* at its lower end portion. The laser printer 100 in this embodiment is configured such that the process cartridge 130 can be attached to or detached from the laser printer 100 at its front face side by opening the front cover 113 toward the front face side (right side in the figure).

A rear cover 114 is arranged at the outer cover 111 at the back face side. This rear cover 114 is detachably mounted to the outer cover 111 so as to be removed when a fixing unit 160 is attached to a fixing unit mounting section 10*b* positioned in the main body 110 at the back face side. Specifically, the outer cover 111 and the rear cover 114 are configured such that the rear cover 114 can be detached from the outer cover 111 in the case where the fixing unit 160 is inserted into the main body 110 along a predetermined inserting direction (rightward direction in the figure).

<<Configuration of feeder unit>>

A feeder case 121 constituting the casing of the feeder unit 120 is configured to be capable of accommodating therein a great number of sheet-like papers in a stacked state. Arranged in the feeder case 121 are a sheet pressing plate 123, a sheet pressing spring 124, a separation pad holder 125 and a separation pad urging spring 126.

The sheet pressing plate 123 is pivotably supported about its end portion at the back face side (the side away from the separation pad holder 125). The end portion of the sheet pressing plate 123 at the front face side (the side close to the separation pad holder 125) is urged in the upward direction by the sheet pressing spring 124. The separation pad holder 125 is arranged in the vicinity of the end portion of the feeder case 121 at the front face side and at the downstream side of the sheet transporting direction from the sheet pressing plate 123. A separation pad 125*a* made of a material having a friction coefficient greater than that of the sheet, such as a rubber or the like, is arranged at the top of the separation pad holder 125 and facing the sheet transporting path PP. The separation pad urging spring 126 for urging the separation pad 125*a* in the upward direction is arranged below the separation pad holder 125.

<<Configuration of process cartridge>>

A developing cartridge 132 is detachably mounted to the process case 131 constituting the casing and the frame of the process cartridge 130. The developing cartridge 132 is arranged at the back face side of the photosensitive drum 133 accommodated in the process case 131. The photosensitive drum 133 is a cylindrical member having a photosensitive layer at its peripheral portion. The photosensitive drum 133 is supported by the process case 131 so as to be capable of rotating in the direction shown by an arrow in the figure in synchronism with the transportation of the sheet upon the image formation. Further, the photosensitive drum 133 is arranged such that its rotational center shaft is parallel to the sheet widthwise direction. The developing cartridge 132 is configured as follows such that toner is supplied to the peripheral surface of the photosensitive drum 133 having a latent image formed thereon to thereby carry the toner onto the peripheral surface as arranged in an image shape (to develop the latent image by toner).

<<Configuration of developing cartridge>>

A toner storing chamber 132*b* for storing toner is formed at the developing cartridge case 132*a*, which constitutes the casing of the developing cartridge 132, at the front face side. An agitator 132*c* for stirring toner stored in the toner storing chamber 132*b* is accommodated in the toner storing chamber 132*b*. The agitator 132*c* is a member of an impeller shape, and it is supported so as to be capable of rotating in the direction shown by an arrow in the figure about the rotational shaft parallel to the sheet widthwise direction by the developing cartridge case 132*a*.

A supply roller 132*d* and a developing roller 132*e* are arranged in the space in the developing cartridge case 132*a* close to the back face side from the toner storing chamber 132*b*. An opening section through which toner can pass is formed at the wall of the toner storing chamber 132*b* at the back face side, whereby toner passing through the opening section by the rotation of the agitator 132*c* can reach the supply roller 132*d*.

The supply roller 132*d* is made by forming a sponge layer at the outer peripheral portion of the metallic rotational center shaft. The supply roller 132*d* is arranged so as to be in contact with the peripheral surface of the developing roller 132*e*, and is rotatably supported to the developing cartridge 132*a*. The supply roller 132*d* is driven to rotate in the direction shown by an arrow in the figure, which makes it possible to carry the charged toner on the peripheral surface of the developing roller 132*e*.

The developing roller 132*e* is made by forming a semiconductive rubber layer, which is made by mixing synthetic resin into a carbon black, at the outer peripheral portion of the metallic rotational center shaft. This developing roller 132*e* is driven to rotate in the direction shown by an arrow in the figure (i.e., the direction same as that of the supply roller 132*d*) as being in contact with the supply roller 132*d*, which makes it possible to carry the charged toner onto the peripheral surface of the developing roller 132*e*.

The developing roller 132*e* is rotatably supported by the developing cartridge case 132*a* such that the developing roller 132*e* is arranged parallel to the peripheral surface of the photosensitive drum 133 with a predetermined clearance with the developing cartridge 132 mounted to the process case 131. Specifically, the process case 131 and the developing cartridge case 132*a* are configured such that the peripheral surface of the developing roller 132*e* exposing toward the outer side of the developing cartridge case 132*a* faces to the peripheral surface of the photosensitive drum 133 via a thin layer of toner carried onto the peripheral surface of the developing roller 132*e*.

A layer thickness regulating blade 132*f* is arranged at the position close to the back face side with respect to the contact portion of the developing roller 132*e* and the supply roller 132*d* (in the direction of rotation of the developing roller 132*e*). The layer thickness regulating blade 132*f* is arranged so as to be capable of adjusting the thickness of the toner layer, toner density and charge quantity on the developing roller 132*e* due to the contact of its leading end with the peripheral surface of the developing roller 132*e*.

<<<Configurations and arrangements of other components in process case>>>

A charger 134 for uniformly charging the peripheral surface of the photosensitive drum 133 is arranged above the photosensitive drum 133. This charger 134 is supported by the process case 131. An opening that is for applying a laser beam onto the peripheral surface of the photosensitive drum 133 and that is a path of the laser beam is formed at the upper section of the process case 131. Specifically, the opening is formed such that the latent image can be formed onto the peripheral surface of the photosensitive drum 133 by the irradiation of the laser beam modulated in accordance with the image information to the peripheral surface of the uniformly charged photosensitive drum 133 through the opening.

A transfer roller 135 for transferring the toner carried onto the peripheral surface of the photosensitive drum 133 onto the sheet is accommodated in the process case 131. This transfer roller 135 is arranged below the photosensitive drum 133 and at the bottom portion of the process cartridge 130 such that the upper portion of its peripheral surface faces the photosensitive drum 133. The transfer roller 135 is rotatably supported by the process case 131. The transfer roller 135 is configured to be capable of transferring the toner carried on the peripheral surface of the photosensitive drum 133 onto the sheet by the application of predetermined voltage between the photosensitive drum 133 and the transfer roller 135 as the transfer roller 135 is driven to rotate in the direction opposite to the rotation of the photosensitive drum 133 (in the direction shown by an arrow in the figure: counterclockwise direction) in synchronism with the rotation of the photosensitive drum 133 in the direction shown by an arrow in the figure (clockwise direction) upon the image formation.

A sheet inlet port 131*a* that is an opening for introducing the sheet into the process case 131 (the aforesaid transfer position) is formed at the bottom portion of the process case 131 and at the upstream side of the sheet transporting direction from the position where the photosensitive drum 133 and the transfer roller 135 face each other. A sheet outlet port 131*b* that is an opening for ejecting the sheet from the process case 131 is formed at the bottom portion of the process case 131 and at the downstream side of the sheet transporting direction from the aforesaid transfer position.

An upper resist roller 136 for adjusting the direction and transporting timing of the sheet is rotatably supported at the outside of the process case 131 and at the upstream side of the sheet transporting direction from the sheet inlet port 131*a*.

<<Configuration of scanner unit>>

A scanner unit 140 is arranged above the process case 131. The scanner unit 140 has a scanner case 141, a polygon mirror 142, a polygon motor 143, an f-θ lens 144, a reflection mirror 145, a cylindrical lens 146, and a reflection mirror 147.

The polygon mirror 142 is supported by the rotational drive shaft of the polygon motor 143, which is fixed to the scanner case 141, so as to be rotatably driven with a predetermined number of revolutions. The polygon mirror 142 is configured to be capable of scanning a laser beam, which is generated at an unillustrated laser beam generating section on the basis of the image data, along the sheet widthwise direction, while rotatably driven by the aforesaid polygon motor 143.

The f-θ lens 144 is a lens for correcting the scanning interval of the laser beam (shown by one-dot-chain line in the figure) reflected by the polygon mirror 142. It is configured to have the longitudinal direction along the rotating direction of the polygon mirror 142. This f-θ lens 144 is arranged between the polygon mirror 142 and the reflection mirror 145.

The cylindrical lens 146 is a lens for cross-scan error compensation, and it is arranged at the place where the laser beam reflected by the reflection mirror 145 via the f-θ lens 144 advances. The reflection mirror 147 is arranged such that the laser beam via the cylindrical lens 146 can be applied to the peripheral surface of the photosensitive drum 133.

These of the f-θ lens 144, reflection mirror 145, cylindrical lens 146, and reflection mirror 147 are held in the scanner case 141.

<<Configuration of sheet feed section>>

A sheet feed section 150 has a pickup roller 151, a separation roller 152, and a lower resist roller 153. It is configured to pick up a sheet one by one from the feeder unit 120 and feed the pick-up sheet to the aforesaid transfer position (the position where the photosensitive drum 133 and the transfer roller 135 face each other) in the process cartridge 130.

The pickup roller 151 is rotatably supported to the main body 110 (the aforesaid main body frame: see a later-described main body frame 110*a* in FIG. 2). This pickup roller 161 is arranged so as to oppose to the end portion of the sheet pressing plate 123 at the front face side in the feeder unit 120 in order that the pickup roller 151 is brought into contact with the leading end of the sheet accommodated in the feeder case 121 in a stacked state.

The separation roller 152 is rotatably supported to the main body 110. The separation roller 152 is arranged at the position facing the separation pad 152*a*. Specifically, the separation roller 152 is arranged so as to be capable of being in contact with the separation pad 152*a* by the separation pad urging spring 126 with a predetermined pressure.

The lower resist roller 153 is a roller for adjusting the direction and transporting timing of the sheet in cooperation with the aforesaid upper resist roller 136. It is arranged at the upstream side of the sheet transporting direction from the position where the photosensitive drum 133 and the transfer roller 135 oppose to each other, so as to be in contact with the upper resist roller 136.

In the sheet feed section 150, a guide member, rollers, or other components for guiding the transportation of the sheet are appropriately arranged between the separation roller 152 and the lower resist roller 153, between the lower resist roller 153 and the sheet inlet port 131*a* at the bottom portion of the process case 131, and between the sheet outlet opening 131*b* at the bottom portion of the process case 131 and the fixing unit 160.

<<Schematic Configuration of Fixing Unit>>

The fixing unit 160 is arranged at the downstream side of the sheet transporting direction from the aforesaid transfer position (the position where the photosensitive drum 133 and the transfer roller 135 oppose to each other). The fixing unit 160 has a fixing unit case 161, a heat roller 162, a pressure roller 163, and a pressure roller support member 164.

The fixing unit case 161 is interposed between the process cartridge 130 and the heat roller 162 to cover the heat roller 162 so as to be capable of inhibiting the process cartridge 130 from being heated by radiation heat from the heat roller 162 as soon as possible.

The heat roller 162 is formed by accommodating a heater 162*b* for heating and melting the toner attached onto the sheet in a roller main body 162*a* that is a metallic thin hollow cylindrical member whose surface is subject to a parting treatment. Both end portions of the heat roller 162 in the sheet widthwise direction are rotatably supported by the fixing unit case 162. The heat roller 162 is arranged along the sheet widthwise direction that is perpendicular to the aforesaid sheet transporting direction and sheet thickness direction.

The pressure roller 163 is made of silicon rubber. It is arranged parallel to the heat roller 162 and opposite to the heat roller 162 so as to be pressed against the heat roller 162 with a predetermined pressure. Both end portions of the pressure roller 163 in the sheet widthwise direction are rotatably supported by the pressure roller support member 164.

The pressure roller support member 164 is a member for rotatably supporting the pressure roller 163 at both end portions of the pressure roller 163 in the sheet widthwise direction. It is arranged at the lower portion of the fixing unit case 161. Specifically, the pressure roller support member 164 is supported so as to be capable of pivotably swaying along the vertical direction in the figure at both end portions of the fixing unit case 161 in the sheet widthwise direction.

This fixing unit 160 is mounted to the main body 110 (the aforesaid main body frame: see the later-described main body frame 110*a* in FIG. 2). It is configured such that the pressure roller 163 follows the rotation of the heat roller 162 in the direction shown by an arrow in the figure through a power transmission mechanism provided to the main body 110, to rotate in the direction shown by an arrow in the figure. The fixing unit 160 is further configured as follows. Specifically, the sheet is nipped between the heat roller 162 and the pressure roller 163 rotating in the direction shown by the arrow in the figure, whereby the toner attached onto the surface of the sheet (the upper surface in the figure) is fixed onto the sheet, while the sheet can be fed in the sheet transporting direction. The detailed configuration of the fixing unit 160 will be described later.

<<Configuration of sheet ejection section>>

The sheet ejection section 170 is composed of a first sheet ejection guide 171, a second sheet ejection guide 172, a first sheet ejection roller 173, and a second sheet ejection roller 174.

The first sheet ejection guide 171 is a member for guiding the sheet subject to the fixing unit 160 along the sheet transporting path PP. It is arranged at the downstream side of the sheet transporting direction from the fixing unit 160. The second sheet ejection guide 172 is a member for guiding the sheet through the first sheet ejection guide 171 toward the sheet ejection port 112*b*. It is arranged at the upstream side of the sheet transporting direction from the sheet ejection port 112*b*.

The first sheet ejection roller 173 and the second sheet ejection roller 174 are arranged so as to be opposite to each other across the paper transporting path PP. The first sheet ejection roller 173 is arranged below the paper transporting path PP. It is rotatably supported by the main body 110 (the aforesaid main body frame: see a later-described main body frame 110*a* in FIG. 2). The first sheet ejection roller 173 is configured to be driven to rotate via the power transmission mechanism provided to the main body 110. The second sheet ejection roller 174 is rotatably supported by a top cover 112. It follows the rotation of the first sheet ejection roller 173.

Further, in the sheet ejection section 170, roller members are arranged at suitable positions between the fixing unit 160 and the sheet ejection port 112*b* and along the paper transporting path PP.

<Detail Configuration of Fixing Unit>

Figure 2:
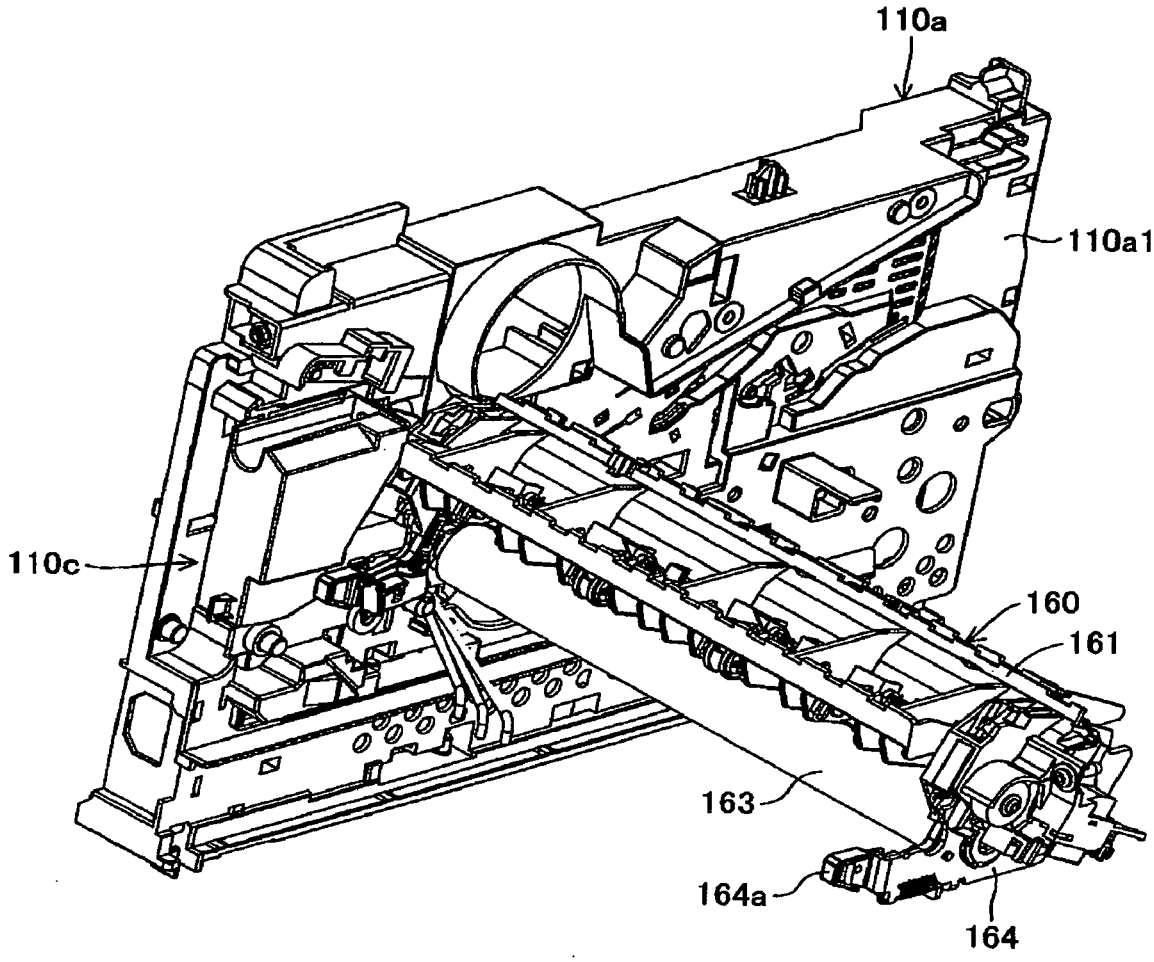
FIG. 2 shows a perspective view, seen from diagonally above, of the inside of the main body frame constituting the main body in a state in which the fixing unit is mounted to the main body shown in FIG. 1.
Figure 3:
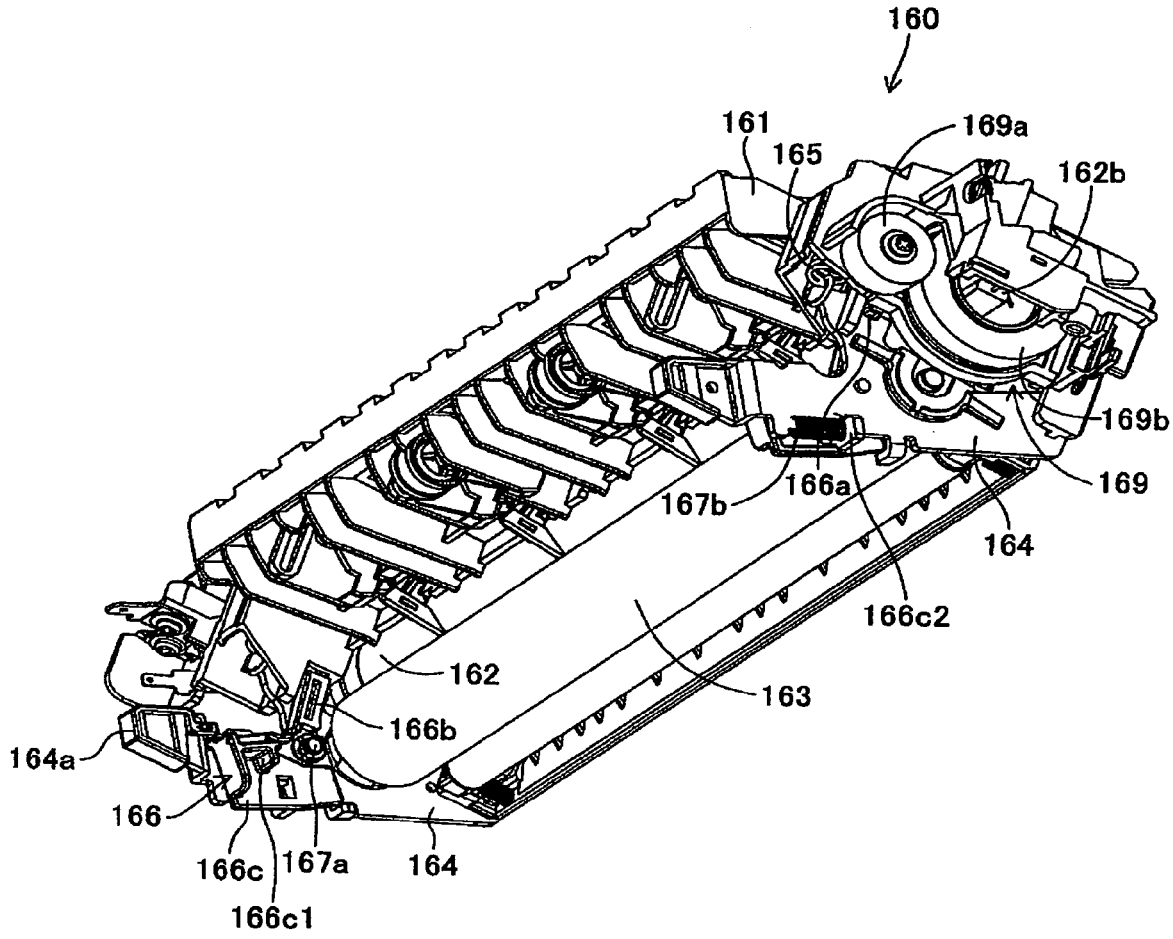
FIG. 3 is a perspective view of the fixing unit shown in FIG. 1 seen from diagonally below.

FIG. 2 shows a perspective view, seen from diagonally above, of the inside of the main body 110 from which the outer cover 111 is removed and to which the fixing unit 160 is mounted. FIG. 3 is a perspective view of the fixing unit 160 seen from diagonally below.

As shown in FIG. 2, the main body frame 110*a* has a pair of side frames 110*a*1 arranged along the sheet widthwise direction. The side frames 110*a*1 are configured to be capable of supporting the fixing unit 160 at its both end portions in the sheet widthwise direction. Formed at the back face side of the main body frame 110*a* is a back-face-side opening section 110*c* that is an opening section for removing a paper jam at the fixing unit 160 or attachment and detachment of the fixing unit 160.

The fixing unit mounting section 110*b* is formed at the end portion of the back-face-side opening section 110*c* at the front face side (at the front side of the direction in which the fixing unit 160 is inserted). The main body frame 110*a* is configured such that the fixing unit 160 can be mounted to the aforesaid fixing unit mounting section 110*b* by inserting the fixing unit 160 into the back-face-side opening section 110*c* toward the front face side.

The back-face-side opening 110*c* is formed to open toward the downstream side in the sheet transporting direction with respect to the fixing unit 160. The fixing unit 160 is mounted to the main body frame 110*a* so as to expose the pressure roller 163 and the free end portion of the pressure roller support member (later-described handle 164*a*) to the outside from the back-face-side opening section 110*c* (from the fixing unit 160 toward the downstream side in the sheet transporting direction, i.e., from the fixing unit 160 toward the back face side) with the rear cover 114 removed from the outer cover 111 in FIG. 1.

With reference to FIG. 2 and FIG. 3, the fixing unit case 161 and the pressure roller support member 164 are configured to expose the peripheral surface of the pressure roller 163 at the side opposite to the side facing the heat roller 162 toward the outside (the side of the downstream side of the sheet transporting direction and lower side).

The pressure roller support member 164 is pivotably and swayably supported by the fixing unit case 161 as described above. A lever-like handle 164*a* for manually swaying the pressure roller support member 164 in a pivotable manner is provided to the free end of the pressure roller support member 164. This handle 164*a* is connected to the main body portion of the pressure roller support member 164 (the portion supporting the pressure roller 163).

Further, this handle 164*a* is arranged so as to be exposed to the outside from the back-face-side opening section 110*c*. Specifically, the handle 164*a* is arranged so as to be capable of being manually operated from the outside (the outside of the fixing unit case 161 and the main body frame 110*a*) with the fixing unit 160 mounted to the main body frame 110*a* and the rear cover 114 removed from the outer cover 111 in FIG. 1.

With reference to FIG. 3, a pressure spring 165 serving as a tension spring is bridged between the fixing unit case 161 and the pressure roller support member 164. The pressure spring 165 is configured to urge the pressure roller support member 164 in the direction in which the pressure roller 163 presses the heat roller 162. Specifically, the pressure spring 165 is configured to bring the pressure roller 163 into a pressure contact with the heat roller 162 by urging the pressure roller support member 164 toward the fixing unit case 161.

<<Detail of configuration of nip state adjusting mechanism>>

With reference to FIG. 3, a spacer member 166 is mounted at the position of the pressure roller support member 164 close to the center of the pivot (the upper-right edge portion of the pressure roller support member 164 in the figure) from the aforesaid handle 164*a*. The spacer member 166 is a member for changing the press-contact state (nip state) between the heat roller 162 and the pressure roller 163 by adjusting the positional relationship between the fixing unit case 161 and the pressure roller support member 164. This spacer member 166 is swayably and pivotably supported about a pivot pin 167*a* that is provided so as to project in the horizontal direction from the pressure roller support member 164.

Figure 4B:
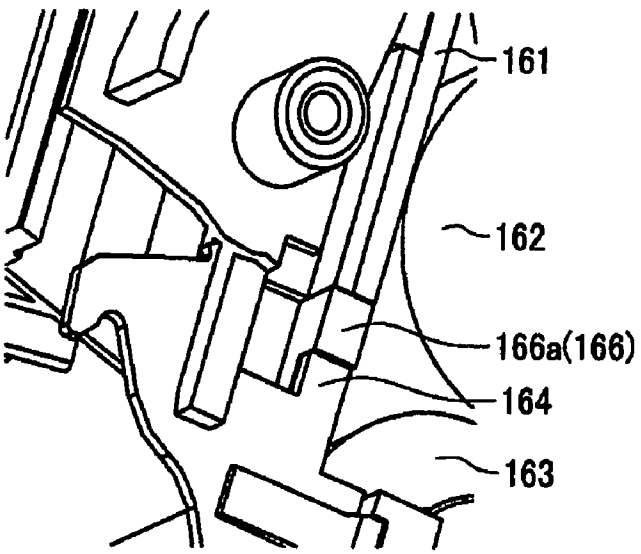
Figure 4A:
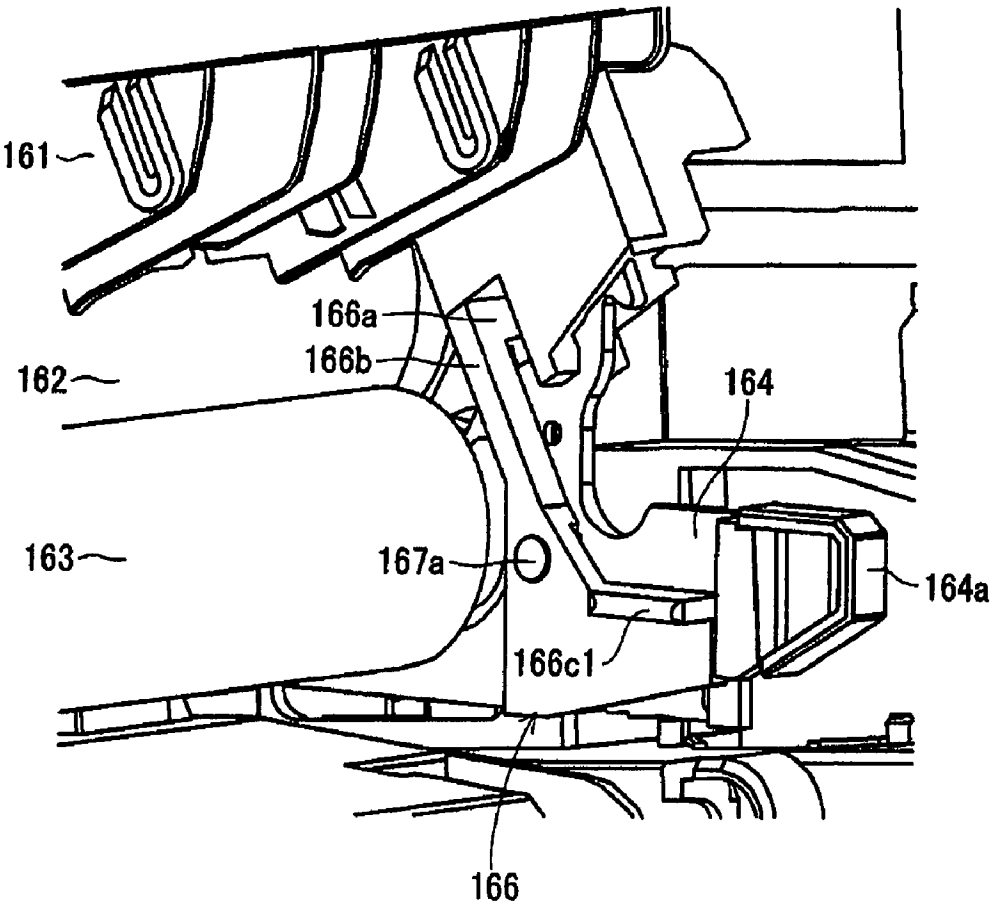
Figure 5B:
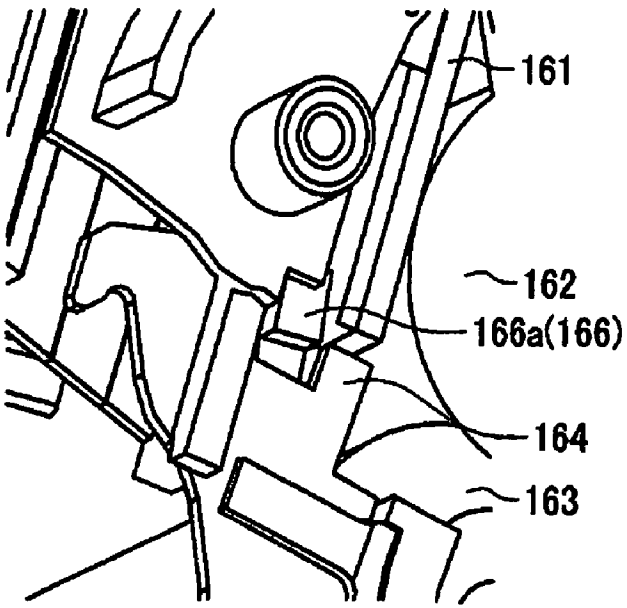
Figure 5A:
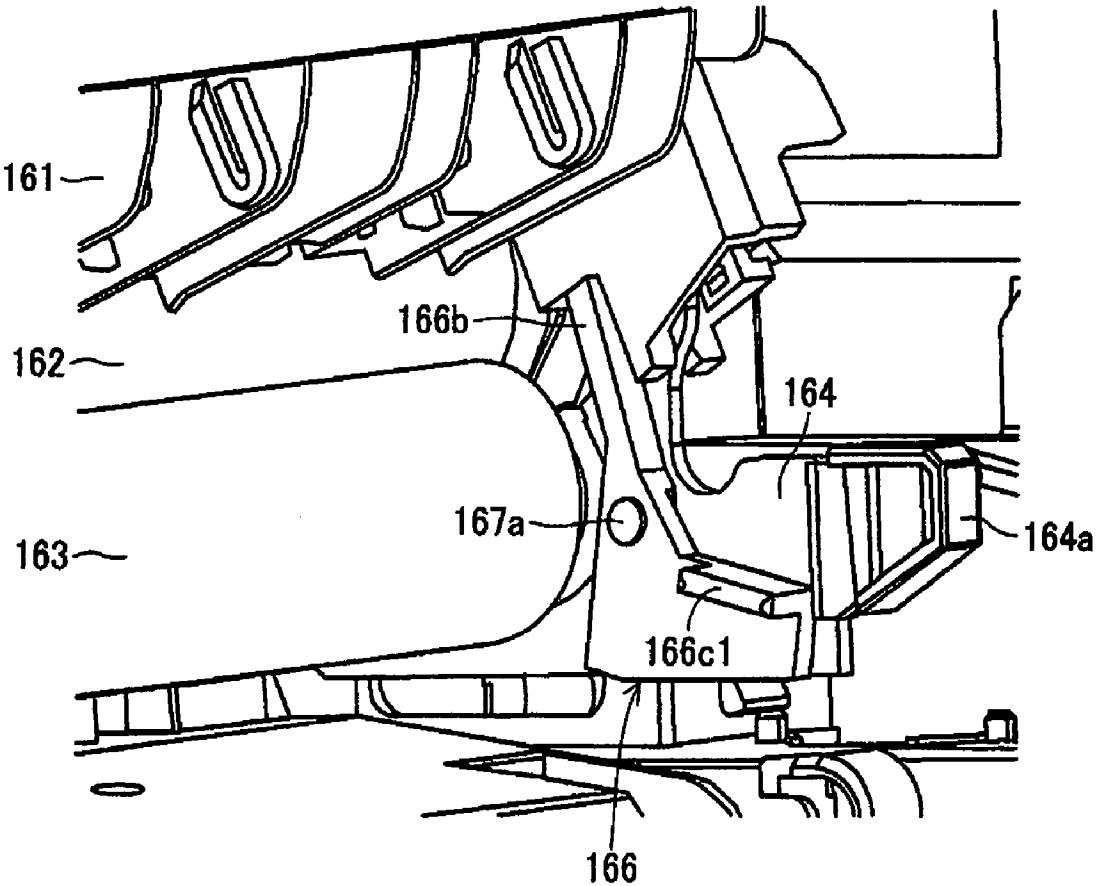

FIG. 4A and FIG. 5A are enlarged perspective views of the surrounding of the spacer member 166 when the spacer member 166 is seen from the inside in the sheet widthwise direction. FIG. 4B and FIG. 5B are enlarged perspective views of the essential part of the spacer member 166 when the spacer member 166 is seen from the outside. It is to be noted that each of different sway states of the spacer member 166 are shown in FIGS. 4A, 4B, 5A and 5B.

With reference to FIGS. 3, 4A and 4B, the spacer member 166 is composed of a spacer section 166*a*, a spacer support section 166*b*, and a spacer operation section 166*c*. The spacer section 166*a* is integrally formed by injection molding of a synthetic resin.

The spacer section 166*a* is a projection formed so as to extend in the horizontal direction from the upper end of the spacer support section 166*b*. It can be clamped between the lower end face of the fixing unit case 161 and the upper end face of the pressure roller support member 164 as shown in FIG. 4B by the sway movement of the spacer support section 166*b* in the rightward direction in the figure (far and leftward direction in FIG. 4A). The position of the spacer section 166*a* where the spacer section 166*a* is clamped between the lower end face of the fixing unit case 161 and the upper end face of the pressure roller support member 164 is referred to as the "first position".

The spacer support section 166*b* is a member for supporting the spacer section 166*a*, and formed so as to extend in the downward direction from the spacer section 166*a*. This spacer support section 166*b* is arranged at the opposite side of the spacer operation section 166*c* across the pivot pin 167*a*. Specifically, the spacer section 166*a* is supported by the spacer support section 166*b* so as to be capable of pivotably swaying between the aforesaid first position and the position where the spacer section 166*a* is not clamped between the lower end face of the fixing unit case 161 and the upper end face of the pressure roller support member (see FIG. 5B: hereinafter referred to as "second position").

The spacer operation section 166*c* is communicated with the spacer support section 166*b*, and is arranged at the position proximate to the handle 164*a* at the pressure roller support member 164. A spacer operation rib 166*c*1 that is operated with fingers is provided so as to project toward the inner side along the sheet widthwise direction at the free end side of the spacer operation section 166*c* and at the front side of the sheet transporting direction.

Specifically, the spacer section 166*a* is configured to be clamped between the lower end face of the fixing unit case 161 and the upper end face of the pressure roller support member 164 for enabling the adjustment of the distance between the shaft of the heat roller 162 and the shaft of the pressure roller 163. Then, the spacer member 166 is configured to be capable of adjusting the press-contact state between the heat roller 162 and the pressure roller 163 by pivotably swaying the spacer section 166*a* between the first position and the second position through the operation of the spacer operation section 166*c* by fingers.

As shown in FIG. 4A and FIG. 5A, the spacer member 166 is arranged to be in contact with the inner face of the pressure roller support member 164 (the inner face in the sheet widthwise direction). Specifically, this spacer member 166 is arranged outward in the sheet widthwise direction from the fixing area where a sheet is nipped between the heat roller 162 and the pressure roller 163.

A plate-like (rib-like) spring contact section 166*c*2 is provided so as to project from the lower end portion of the spacer operation section 166*c* toward the outer side along the sheet widthwise direction. The spacer urging spring 167*b* that is a compression spring is arranged between the spring contact portion 166*c*2 and the portion of the pressure roller support member 164 in the vicinity of the handle 164*a*. The spacer urging spring 167*b* is configured to be capable of urging the spacer support section 166*b* toward the right in the figure.

<Outline of image forming operation by laser printer>

The outline of the image forming operation by the laser printer 100 having the above-mentioned configuration will be explained hereinafter with reference to FIG. 1.

<<Sheet feeding operation>>

Sheets accommodated in a stacked state in the feeder case 121 are urged upward toward the pickup roller 151 by the sheet pressing plate 123. Accordingly, several sheets from the uppermost sheet are brought into contact with the peripheral surface of the pickup roller 151. When the pickup roller 151 is driven to rotate counterclockwise in the figure, the leading end portions of the several sheets move in the rightward direction, and are nipped between the separation roller 152 and the separation pad 125*a*. When the separation roller 152 is driven to rotate counterclockwise in the figure, only the uppermost sheet that is brought into contact with the peripheral surface of the separation roller 152 is transported toward the position (resist position) where the upper resist roller 136 and the lower resist roller 155 come in contact with each other with the rotation of the separation roller 152.

The abutment of the leading end portions of the sheets against the resist position corrects the inclination of the sheet. Thereafter, the lower resist roller 155 is driven to rotate at a predetermined timing. Therefore, the upper resist roller 136 rotates as followed by the rotation of the lower resist roller 155, and further, the sheet is transported to the transfer position where the photosensitive drum 133 and the transfer roller 135 oppose to each other. In this manner, the correction of inclination of the sheet and adjustment of the transporting timing are executed.

<<Carriage of toner image onto peripheral surface of photosensitive drum>>

During the transportation of the sheet toward the aforesaid transfer position as described above, a toner image is carried onto the peripheral surface of the photosensitive drum 133 as follows.

At first, the peripheral surface of the photosensitive drum 133 is uniformly charged by the charger 134. The laser beam scanned along the sheet widthwise direction by the scanner unit 140 is applied onto the peripheral surface of the photosensitive drum 133 charged by the charger 134 and rotating in the direction shown by the arrow in the figure (clockwise direction). The laser beam is generated based upon the image data, as described above. Specifically, the light-emitting state (ON/OFF pulse shape) is modulated according to the image data. The modulated laser beam is scanned on the peripheral surface of the photosensitive drum 133, whereby the latent image is formed on the peripheral surface. The peripheral surface of the photosensitive drum 133 having the latent image formed thereon is rotated in the direction shown by the arrow in the figure (clockwise direction), so that it comes in contact with or in proximity to the peripheral surface of the developing roller 132*e*. The charged toner is uniformly carried on the peripheral surface of the developing roller 132*e* as described later.

The supply roller 132*d* rotates in the direction shown by an arrow in the figure (counterclockwise direction), so that toner is attached onto the peripheral surface of the developing roller 132*e*. The peripheral surface of the developing roller 132*e* having the toner attached thereon by the supply roller 132*d* rotates in the direction shown by the arrow in the figure (counterclockwise direction: i.e., the rotational direction same as that of the supply roller 132*d*), so that it reaches the contact position to the layer thickness regulating blade 132*f*. The amount of attachment and/or charge quantity of toner on the peripheral surface is adjusted by the layer thickness regulating blade 132*f*. In this manner, the peripheral surface having toner whose amount of attachment and/or charge quantity is adjusted rotates in the direction shown by the arrow in the figure (counterclockwise direction), whereby it reaches the position opposite to the photosensitive drum 133.

The peripheral surface of the photosensitive drum 133 having the latent image formed thereon and the peripheral surface of the developing roller 132*e* having the charged toner carried thereon come in contact with each other or in proximity to each other, whereby the toner is attached with a pattern corresponding to the latent image formed on the peripheral surface of the photosensitive drum 133. Specifically, the latent image on the peripheral surface of the photosensitive drum 133 is developed by the toner, and the toner image is carried onto the peripheral surface.

<<Transfer of toner image from peripheral surface of photosensitive drum to sheet>>

The toner image carried onto the peripheral surface of the photosensitive drum 133 as described above is transported to the aforesaid transfer position by the rotation of this peripheral surface in the clockwise direction in the figure. Then, the toner image is transferred from the peripheral surface of the photosensitive drum 133 to the sheet at this transfer position.

<<Fixation and sheet ejection>>

The sheet having the toner image transferred thereon is sent to the fixing unit 160 along the paper transporting path PP. This sheet is nipped between the heat roller 162 and the pressure roller 163 in order to apply pressure and heat. Thus, the toner image is fixed on the surface of the sheet. Thereafter, the sheet is sent to the sheet ejection port 112*b* via the sheet ejection section 170 by the rotations of the heat roller 162 and the pressure roller 163 in the direction shown by the arrow in the figure, and then, ejected onto the catch tray 112*a* via the sheet ejection port 112*b*.

<Adjusting operation of nip state>

When the laser printer 100 and the fixing unit 160 are shipped from a factory, the spacer section 166*a* is set to be clamped between the lower end face of the fixing unit case 161 and the upper end face of the pressure roller support member 164 as shown in FIG. 4.

In the case where an image formation is performed to a sheet having a normal thickness with the use of the laser printer 100, the handle 164*a* is manually pulled down against the pressure spring 165 before the image formation. Consequently, the spacer section 166*a* is urged toward the back face side by the spacer urging spring 167*b*. As shown in FIGS. 5A and 5B, the spacer member 166 sways pivotably about the pivot pin 167*a* in the direction in which the spacer section 166*a* moves to the back face side. Accordingly, as shown in FIG. 5B, the spacer section 166*a* is departed from the position where it is clamped between the lower end face of the fixing unit case 161 and the upper end face of the pressure roller support member 164.

When the pull-down of the handle 164 is released after the sway movement of the spacer section 166*a*, the pressure roller support member 164 is pulled up by the pressure spring 165 (see FIG. 3), so that it moves up. Accordingly, the distance between the fixing unit case 161 that supports the heat roller 162 and the pressure roller support member 164 that supports the pressure roller 163 decreases, whereby the distance between the shaft of the heat roller 162 and the shaft of the pressure roller 163 decreases. As a result, the nip width of the heat roller 162 and the pressure roller 163 (the length of the contact portion of the heat roller 162 and the pressure roller 163 along the rotational direction of the heat roller 162) increases.

On the other hand, in the case where an image formation is carried out for an envelope or thick paper, the spacer operation rib 166*c*1 is manually pushed up and the handle 164*a* is manually pulled down against the pressure spring 165, before the image formation. Therefore, the spacer section 166*a* is moved toward the front face side against the spacer urging spring 167*b*. Thereafter, when the pull-down of the handle 164*a* is released, the spacer section 166*a* is clamped between the lower end face of the fixing unit case 161 and the upper end face of the pressure roller support member 164 as shown in FIG. 4B. Accordingly, the fixing unit case 161 that supports the heat roller 162 and the pressure roller support member 164 that supports the pressure roller 163 are apart from each other by the distance corresponding to the size of the spacer section 166*a*, whereby the distance between the shaft of the heat roller 162 and the shaft of the pressure roller 163 increases. Therefore, the nip width of the heat roller 162 and the pressure roller 163 (the length of the contact portion of the heat roller 162 and the pressure roller 163 along the rotational direction of the heat roller 162) decreases.

<Operation and effect by configuration of embodiment>

Subsequently, the operation and effect provided by the configuration of the aforesaid embodiment will be explained with reference to each drawing.

With reference to FIG. 3 or FIGS. 5A and 5B, in the configuration of this embodiment, the press-contact state adjusting mechanism for changing the press-contact state (nip state) between the heat roller 162 and the pressure roller 163 is composed of the aforesaid spacer member 166. This spacer member 166 is provided to the pressure roller support member 164 so as to be capable of pivotably swaying as described above. Specifically, the spacer member 166 constituting the press-contact state adjusting mechanism is always mounted to the pressure roller support member 164 that is the component of the fixing unit 160.

Therefore, even if the spacer member 166 is not used, the spacer member 166 is always mounted to the fixing unit 160, so that the loss of the spacer member 166 is prevented.

The spacer member 166 constituting the aforesaid press-contact state adjusting mechanism is provided to the fixing unit 160, not to the main body 110 of the laser printer 100. The spacer member 166 is configured to be capable of being manually operated from the outside of the main body 110 without using a motor or cam mechanism provided at the main body 110 of the laser printer 100. According to this configuration, even if the power source of the laser printer 100 is cut off, the aforesaid press-contact state can be changed. In particular, the permanent set of the pressure roller 163 can be inhibited by releasing or easing the aforesaid press-contact state when the laser printer 100 is not used. Accordingly, the service life of the fixing unit 160 can be prolonged, and the maintenance property of the laser printer 100 is further enhanced.

Further, the press-contact state adjusting mechanism for changing the press-contact state (nip state) between the heat roller 162 and the pressure roller 163 is composed of the spacer member 166 having an extremely simple configuration as described above. Accordingly, the device structure relating to the press-contact state adjusting mechanism can be made simple and compact, whereby the fixing unit 160 and the laser printer 100 can be downsized and the cost for the fixing unit 160 and the laser printer 100 can be reduced.

With reference to FIG. 3, in the configuration of this embodiment, the fixing unit case 161 and the counter roller support member 164 are configured to expose the peripheral surface of the pressure roller 163 at the side opposite to the side facing the heat roller 162. Accordingly, the maintenance property of the fixing device, such as paper jam process (removal of the jammed paper) is further enhanced. Therefore, the workability for performing the maintenance operation of the fixing unit 160 is further enhanced.

Moreover, the cover member for covering the pressure roller 183 is omitted, so that the outer dimension of the fixing unit 160 can be reduced. Therefore, the fixing unit mounting section 110*b* at the main body frame 110*a* has the minimum dimension. Accordingly, further miniaturization of the configuration of the surrounding of the fixing unit 160 can be achieved in the laser printer 100 according to this embodiment, and hence, further miniaturization of the laser printer 100 is made possible.

With reference to FIGS. 4A, 4B, 5A and 5B, in the configuration of this embodiment, the spacer member 166 is arranged outward, in the widthwise direction, from the fixing area where the recording medium is nipped between the heat roller 162 and the pressure roller 163.

According to this configuration, the spacer member 166 is located at the position apart from the peripheral surfaces of the heat roller 162 and the pressure roller 163 used for the image fixing operation to the sheet. Therefore, the poor image formation (undesirable vertical stripes or the like) due to the damage on the peripheral surfaces by the spacer member 166 can be prevented. Moreover, the spacer member 166 does not disturb the maintenance operation such as the aforesaid paper jam process.

With reference to FIGS. 3 to 5A and 5B, in the configuration of this embodiment, the spacer operation section 166*c* that is communicated with the spacer support section 166*b* and can be operated from the outside of the fixing unit case 161 is formed at the spacer member 166.

According to this configuration, the press-contact state between the heat roller 162 and the pressure roller 163 can easily be adjusted by operating the spacer operation section

166*c* from the outside of the fixing unit case 161 (the outside of the main body 110 from which the rear cover 114 is removed in FIG. 1).

With reference to FIG. 3, in the configuration of this embodiment, the spacer urging spring 167*b* that urges the spacer support section 166*b* in the direction in which the spacer section 166*a* moves toward the second position from the first position is provided. Further, in the configuration of this embodiment, the pressure spring 165 that urges the pressure roller support member 164 in the direction in which the pressure roller 163 presses the heat roller 162 is provided. Moreover, in the configuration of this embodiment, the handle 164*a* that can be operated from the outside of the fixing unit case 161 (the outside of the main body 110 from which the rear cover 114 is removed in FIG. 1) is formed at the pressure roller support member 164.

According to this configuration, the adjustment of the press-contact state between the heat roller 162 and the pressure roller 163 due to the pivotable sway movement of the spacer member 166 can easily be performed by interlocking the spacer urging spring 167*b* with the pressure spring 165.

Specifically, in the case where the spacer section 166*a* is located at the first position, only pulling down the handle 164*a* automatically and promptly moves the spacer section 166*a* to the second position. The manual operation of the handle 164*a* described above is easily performed from the outside of the main body frame 110*a* (see FIG. 2) and the fixing unit case 161 via the back-face-side opening section 110*c* (FIG. 2).

<MODIFIED EXAMPLE>

Notably, the embodiment that is considered to be the best by the present applicant for the time being at the filing of this application is only illustrated above. Therefore, the present invention is not limited to the aforesaid embodiment, and various modifications are naturally possible without departing from the spirit of the present invention.

Some of the modified examples will be illustrated below. It is needless to say that the modified examples are not limited thereto.

(i) An image forming apparatus to which the invention is applied is not limited to a laser printer. Further, the configurations unrelated to the gist of the invention, such as the feeder unit 120, process cartridge 130, scanner unit 140, or the like, can take various configurations other than those disclosed in the above-mentioned embodiment. For example, the present invention is preferably applicable to a configuration in which the feeder unit 120 is omitted and a sheet is only supplied manually.

(ii) The nip state between the heat roller 162 and the pressure roller 163 may be released (the peripheral surface of the heat roller 162 and the peripheral surface of the pressure roller 163 are apart from each other) in the state in which the spacer section 166*a* is not clamped between the lower end face of the fixing unit case 161 and the upper end face of the pressure roller support member 164 shown in FIG. 5B.

(iii) The urging direction by the spring to the spacer member 166 may be opposite to the direction in the aforesaid embodiment. Specifically, the spacer urging spring 167*b* may be configured to urge the spacer section 166*a* toward the first position.

According to this configuration, for example, when the laser printer 100 (fixing unit 160) is not used for a long time or when the process for clearing paper jam is performed, the handle 164*a* provided at the free end portion of the pressure roller support member 164 is manually pushed down, whereby the spacer section 166*a* moves toward the front face side. Accordingly, as shown in FIG. 4B, the spacer section 166*a* is clamped between the lower end face of the fixing unit case 161 and the upper end face of the pressure roller support member 164. Thus, the condition in which the press-contact between the heat roller 162 and the pressure roller 163 is eased or released is surely maintained. Consequently, this configuration prevents the permanent set of the pressure roller 163 and achieves a satisfactory maintenance property.

Further, it is supposed for example that the spacer section 166*a* is located at the first position at the initial state (e.g., when the laser printer 100 or the fixing unit 180 is shipped from a factory). At this time, the spacer section 166*a* is always urged toward the first position and clamped between the fixing unit case 161 and the pressure roller support member 164 with a predetermined pressure by the pressure spring 165. Therefore, even if vibration or shock is applied upon the transportation of the laser printer 100 or the fixing unit 160, the condition in which the press-contact between the heat roller 162 and the pressure roller 163 is eased or released is surely maintained. Accordingly, the permanent set of the pressure roller 163 is prevented.

(iv) The components expressed in operational and functional manners in each component constituting the means for solving the problem of the invention include any structures that can realize the operation and function, in addition to the specific structure, disclosed in the aforesaid embodiment and modified examples.

What is claimed is:

1. A fixing device that is configured to be capable of fixing an image by a developer onto a sheet-like recording medium, and comprises:

a heat roller arranged along a widthwise direction of the recording medium that is perpendicular to a transporting direction and a thickness direction of the recording medium, and is configured to be capable of heating the developer;

a counter roller that is arranged along the widthwise direction of the recording medium so as to face the heat roller, in order to send the recording medium in the transporting direction due to the rotation with the recording medium nipped with the heat roller;

a fixing unit case that is configured to rotatably support both end portions of the heat roller in the widthwise direction and to cover the heat roller;

a counter roller support member that is supported at both end portions of the widthwise direction of the fixing unit case in a swayable manner, and configured to rotatably support both end portions of the counter roller in the widthwise direction;

a spacer member composed of a spacer section that is configured to be clamped between the fixing unit case and the counter roller support member in order to adjust a distance between a shaft of the heat roller and a shaft of the counter roller, and a spacer support section that is provided so as to extend from the spacer section, wherein the spacer support section at the spacer section is supported by the counter roller support member so as to be capable of swaying between a first position where the spacer section is clamped between the fixing unit case and the counter roller support member and a second position where the spacer section is not clamped between the fixing unit case and the counter roller support member.

2. The fixing device according to claim 1, wherein the fixing unit case and the counter roller support member are configured to expose a peripheral surface of the counter roller at a side opposite to a side facing the heat roller.

3. The fixing device according to claim 2, wherein the spacer member is arranged outward, in the widthwise direction, from a fixing area where the recording medium is nipped between the heat roller and the counter roller.

4. The fixing device according to claim 3, wherein a spacer operation section that is communicated with the spacer support section and can be operated from the outside of the fixing unit case is formed at the spacer member.

5. The fixing device according to claim 4, further comprising a spacer urging member that urges the spacer support section in a direction in which the spacer section moves toward the first position or the second position.

6. The fixing device according to claim 5, further comprising a counter roller urging member that urges the counter roller support member in a direction in which the counter roller presses the heat roller.

7. The fixing device according to claim 6, wherein a counter roller operation section that can be operated from the outside of the fixing unit case is formed at the counter roller support member.

8. An image forming apparatus that is configured to be capable of fixing an image by a developer on a recording medium to form an image onto the recording medium, comprising:

a fixing unit that is configured to be capable of fixing the image by the developer attached to the recording medium onto the recording medium; and a main body to which the fixing unit is mounted, wherein a fixing unit mounting section to which the fixing unit is mounted by a insertion of the fixing unit in a predetermined inserting direction is formed at the main body, the fixing unit comprising:

a heat roller arranged along a widthwise direction of the recording medium that is perpendicular to a transporting direction and a thickness direction of the recording medium, and is configured to be capable of heating the developer;

a counter roller that is arranged along the widthwise direction of the recording medium so as to face the heat roller, in order to send the recording medium in the transporting direction due to rotation with the recording medium nipped with the heat roller;

a fixing unit case that is configured to be mountable on the fixing unit mounting section so as to rotatably support both end portions of the heat roller in the widthwise direction and to cover the heat roller;

a counter roller support member that is supported at both end portions of the widthwise direction of the fixing unit case in a swayable manner, and rotatably support both end portions of the counter roller in the widthwise direction; and a spacer member composed of a spacer section that is configured to be clamped between the fixing unit case and the counter roller support member in order to adjust a distance between a shaft of the heat roller and a shaft of the counter roller, and a spacer support section that is provided so as to extend from the spacer section, wherein the spacer support section at the spacer section is supported by the counter roller support member so as to be capable of swaying between a first position where the spacer section is clamped between the fixing unit case and the counter roller support member and a second position where the spacer section is not clamped between the fixing unit case and the counter roller support member.

9. The image forming apparatus according to claim 8, wherein the fixing unit case and the counter roller support member are configured to expose a peripheral surface of the counter roller at a side opposite to a side facing the heat roller.

10. The image forming apparatus according to claim 9, wherein the spacer member is arranged outward, in the widthwise direction, from a fixing area where the recording medium is nipped between the heat roller and the counter roller.

11. The image forming apparatus according to claim 10, wherein a spacer operation section that is communicated with the spacer support section is formed at the spacer member; and the spacer operation section is provided so as to project from the fixing unit toward a near side in the inserting direction in order to be capable of being operated from the outside of the main body.

12. The image forming apparatus according to claim 11, further comprising a spacer urging member that urges the spacer support section in a direction in which the spacer section moves toward the first position or the second position.

13. The image forming apparatus according to claim 12, further comprising a counter roller urging member that urges the counter roller support member in a direction in which the counter roller presses the heat roller.

14. The image forming apparatus according to claim 13, wherein a lever-like counter roller operation section is formed at the counter roller support member; and the counter roller operation section is provided so as to project from the fixing unit toward a near side in the inserting direction in order to be capable of being operated from the outside of the main body.

* * * * *

UNITED STATES PATENT AND TRADEMARK OFFICE

CERTIFICATE OF CORRECTION

PATENT NO. : 7,440,723 B2
APPLICATION NO. : 11/482108
DATED : October 21, 2008
INVENTOR(S) : Junji Uehara et al.

It is certified that error appears in the above-identified patent and that said Letters Patent is hereby corrected as shown below:

In Column 21, Claim 8, Line 34:
Please delete "body," and insert --body section,--

Signed and Sealed this

Twenty-third Day of June, 2009

John Doll

JOHN DOLL
*Acting Director of the United States Patent and Trademark Office*